US005525775A

United States Patent [19]

Setoriyama et al.

[11] Patent Number: 5,525,775

[45] Date of Patent: Jun. 11, 1996

[54] HEATING APPARATUS USING ENDLESS FILM

[75] Inventors: Takeshi Setoriyama; Akira Kuroda, both of Yokohama; Shinichi Sasaki, Fujisawa, all of Japan

[73] Assignee: Canon Kabushiki Kaisha, Tokyo, Japan

[21] Appl. No.: 347,182

[22] Filed: Nov. 22, 1994

Related U.S. Application Data

[63] Continuation of Ser. No. 52,276, Apr. 26, 1993, abandoned, which is a continuation of Ser. No. 712,532, Jun. 10, 1991, abandoned.

[30] Foreign Application Priority Data

Jun. 11, 1990 [JP] Japan ..... 2-153602
Jun. 11, 1990 [JP] Japan ..... 2-153607
Jun. 11, 1990 [JP] Japan ..... 2-153608

[51] Int. Cl.[6] ..... G03G 15/20

[52] U.S. Cl. ..... 219/216; 355/290

[58] Field of Search ..... 355/282, 285, 355/289, 290; 219/216; 198/832–835; 162/205, 206; 474/101, 102, 106, 107, 140

[56] References Cited

U.S. PATENT DOCUMENTS 2,655,252 10/1953 Spurgeon ..... 474/107 X
3,811,828 5/1974 Ohta et al. ..... 219/216 X
4,003,783 1/1977 Groome et al. ..... 162/206
4,287,021 9/1981 Justus et al. ..... 162/205 X
4,565,439 1/1986 Reynolds ..... 355/290
4,954,845 9/1990 Yano et al. ..... 355/290
4,998,121 5/1991 Koh et al. ..... 346/160
5,026,276 6/1991 Hirabayashi et al. ..... 219/216 X
5,027,160 6/1991 Okada et al. ..... 355/282
5,043,763 8/1991 Koh et al. ..... 355/285 X

FOREIGN PATENT DOCUMENTS

0109283A1 5/1984 European Pat. Off. .
0362791A3 4/1990 European Pat. Off. .
0369378A1 5/1990 European Pat. Off. .
0411588A2 2/1991 European Pat. Off. .

OTHER PUBLICATIONS

Hirabayashi et al., EPA #295, 901, Dec. 21, 1988.

*Primary Examiner*—Robert Beatty
*Attorney, Agent, or Firm*—Fitzpatrick, Cella, Harper & Scinto

[57] ABSTRACT

An image heating apparatus includes a heater, an endless film contacting the heater and a back-up member cooperative with the heater to form a nip with the film sandwiched between it and the heater. A recording material having an image is passed between the back-up member and the film to heat the image by heat from the heater through the film. A guide is disposed for guiding the film and allowing the film to extend loosely around the guide. The film is under tension at least upstream of the nip and in the nip when the film is driven and is not guided by the guide between the upstream guide portion and the nip.

14 Claims, 9 Drawing Sheets

HEATING APPARATUS USING ENDLESS FILM

This application is a continuation of application Ser. No. 08/052,276, filed Apr. 26, 1993, now abandoned, which is a continuation of application Ser. No. 07/712,532, filed Jun. 10, 1991, now abandoned.

FIELD OF THE INVENTION AND RELATED ART

The present invention relates to an image heating apparatus for fixing an image on a recording material or improving the quality of the image thereon. More particularly,it relates to an image heating apparatus wherein the recording material is heated while it is passed through the nip formed between a pressing member and a film contacted to a heater.

Conventionally, the heating apparatus for fixing an image by heat uses a heating roller which is maintained at a predetermined temperature and a pressing roller which has an elasticity and which is press-contacted to the heating roller, by which a nip is formed therebetween, through which the recording material is passed through.

In such types of the apparatus, the thermal capacity of the heating roller is required to be large to prevent temperature change. As a result, a long waiting period is required when the apparatus is started.

U.S. Ser. Nos. 07/206,767 (now U.S. Pat. No. 5,132,515), 07/387,970 (now U.S. Pat. No. 4,954,845), 07/409,341 (now U.S. Pat. No. 5,043,763), 07/416,539 (now U.S. Pat. No. 4,998,121), 07/426,082 (now U.S. Pat. No. 5,026,276), 07/435,247 (now U.S. Pat No. 5,171,145), 07/430,437(now U.S. Pat. No. 5,083,168), 07/440,380, 07/440,678, 07/444, 802, 07/446,449 (now U.S. Pat No. 5,027,160), 07/496,957, 07/502,223 (now U.S. Pat No. 5,179,263), which have been assigned to the assignee of this application have proposed an image fixing apparatus, wherein use is made of quick response heater and thin film, so that the waiting period is significantly reduced.

FIG. 13 shows an example of such an image fixing apparatus using the film. A heat resistive film 51 in the form of an endless belt is tightly stretched around three parallel members: a left side driving roller 52, a right side follower roller 53 and a low thermal capacity linear heater 54.

When the driving roller 52 rotates in the clockwise direction, the fixing film 51 is rotated in the clockwise direction at a predetermined speed. More particularly, it is rotated at a speed which is substantially the same as the speed of conveyance of a recording sheet P (process speed) which has an unfixed toner image formed thereon by an unshown image forming station.

A pressing member in the form of a roller 55 is urged to the bottom surface of the heater 54, with the bottom travel of the fixing film 51 therebetween, by an unshown urging means. It rotates following the recording sheet P in the same direction as the recording sheet P.

A heater 54 extends in a direction crossing with the direction of the surface movement of the fixing film 51 (the direction of the width of the fixing film 51). It is a low thermal capacity linear heater, and comprises a heater base 56, an electrically energizable resistor (heat generation element) 57, a surface protection layer 58, and a temperature detecting element 59. The heater 54 is securedly mounted on a supporting member 61 through an insulating member 60.

The recording sheet P carrying an unfixed toner image Ta on its top surface, is guided by a guide 62 and is introduced into a nip N between the heater 54 and the pressing roller 55, and more particularly, between the fixing film 51 and the pressing roller 55. The surface having the unfixed toner image is moved at the same speed as the fixing film 51 in close contact with the fixing film 51 through the nip N between the heater 54 and the pressing roller 55.

The heater 54 is supplied with electric energy at the predetermined timing, and the generated heat is transferred to the recording sheet P which is in close contact with the fixing film 51 through the fixing film 51. The toner image is softened or fused into a softened or fused image Tb during passage thereof through the nip N.

The fixing film 51 is deflected at a relatively large curvature by the edge S of the insulating member 60. Therefore, the recording sheet P being conveyed together with fixing film 51 is separated by the curvature change from the fixing film 51 at the edge S, and is discharged. By the time it reaches the discharging station, the toner is sufficiently solidified and fixed on the recording sheet P as the fixed image Tc.

In the case of using such an endless film, the following problems arise. Since the entire circumference of the fixing film 51 is subjected to tension at all times, the torque required for driving the fixing film 51 is relatively large. Since it is difficult to completely maintain the parallelism among the driving roller 52, the follower roller 53 and the heater 54, the fixing film 51 receives a lateral shifting force when it is rotated. When the fixing film 51 is stretched by the tension, the lateral shifting force is large. If an attempt is made to reduce the thickness of the fixing film 51 in order to reduce the waiting period, a large shifting force results in the production of a crease in the fixing film 51.

U.S. Ser. No. 446,449 (now U.S. Pat. No. 5,027,160) proposes the use of a solenoid to shift the follower roller to control the lateral shift of the fixing film 51, but if the degree of the lateral shift is large, it would not be possible to control it by simply abutting the lateral edges to limiting parts, and therefore, a particular control mechanism is required.

SUMMARY OF THE INVENTION

Accordingly, it is a principal object of the present invention to provide an image heating apparatus wherein the lateral shifting tendency of the heating film is reduced.

It is another object of the present invention to provide an image heating apparatus, wherein a lateral edge of a heating film is controlled.

It is a further object of the present invention to provide an image heating apparatus, wherein a heating film in the form of an endless belt is loosely supported.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
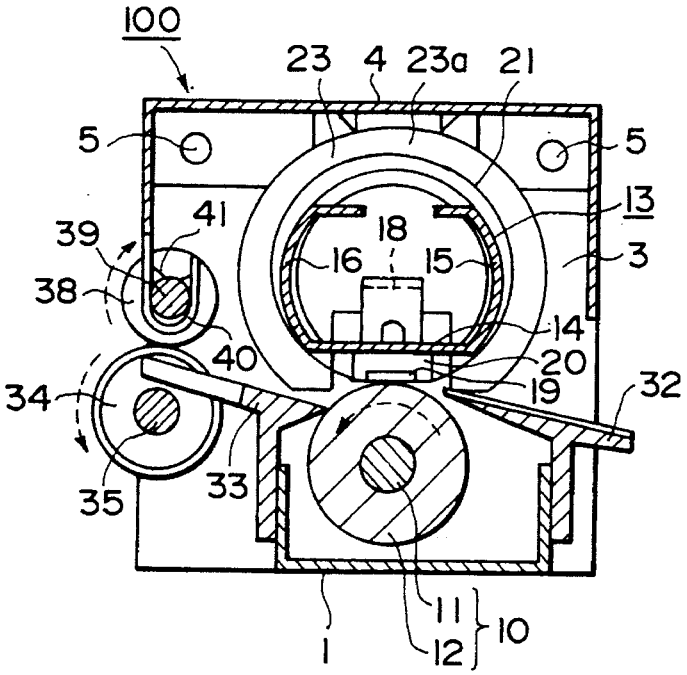
FIG. 1 is a sectional view of an image fixing apparatus according to an embodiment of the present invention.
Figure 3:
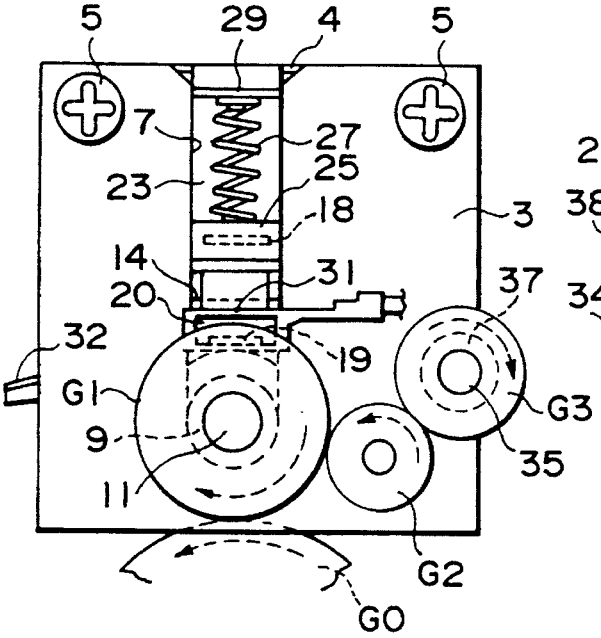
FIG. 3 is a right side view of the image fixing apparatus.
Figure 4:
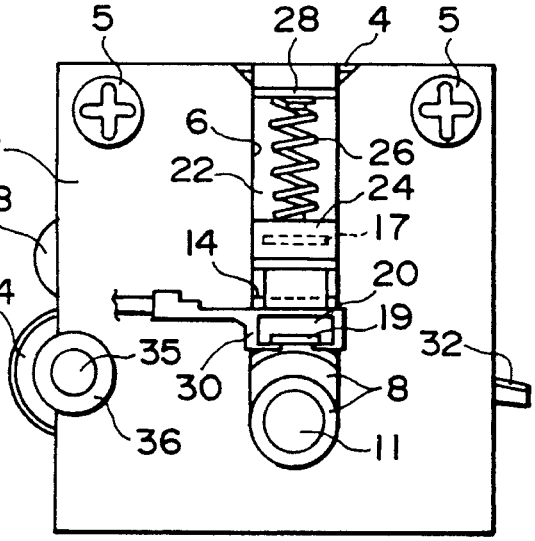
FIG. 4 is a left side view of the image fixing apparatus.
Figure 2:
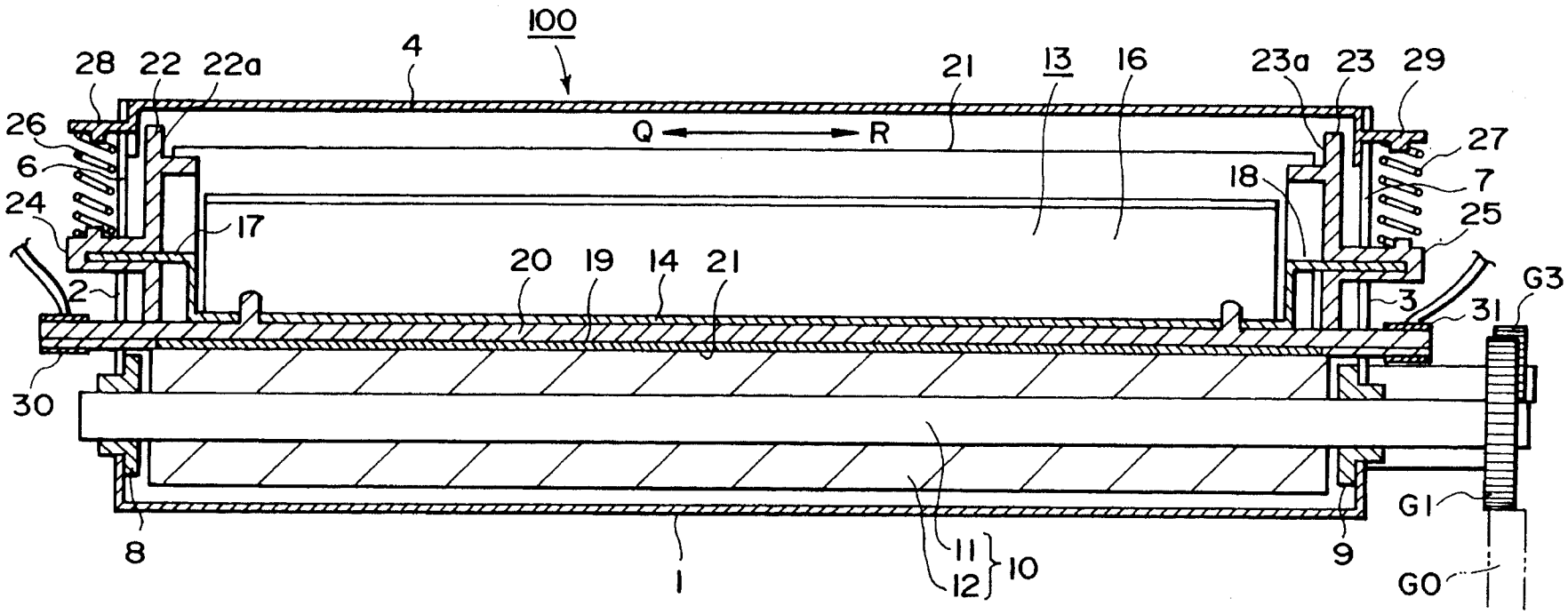
FIG. 2 is a longitudinal sectional view of the image fixing apparatus.
Figure 5:
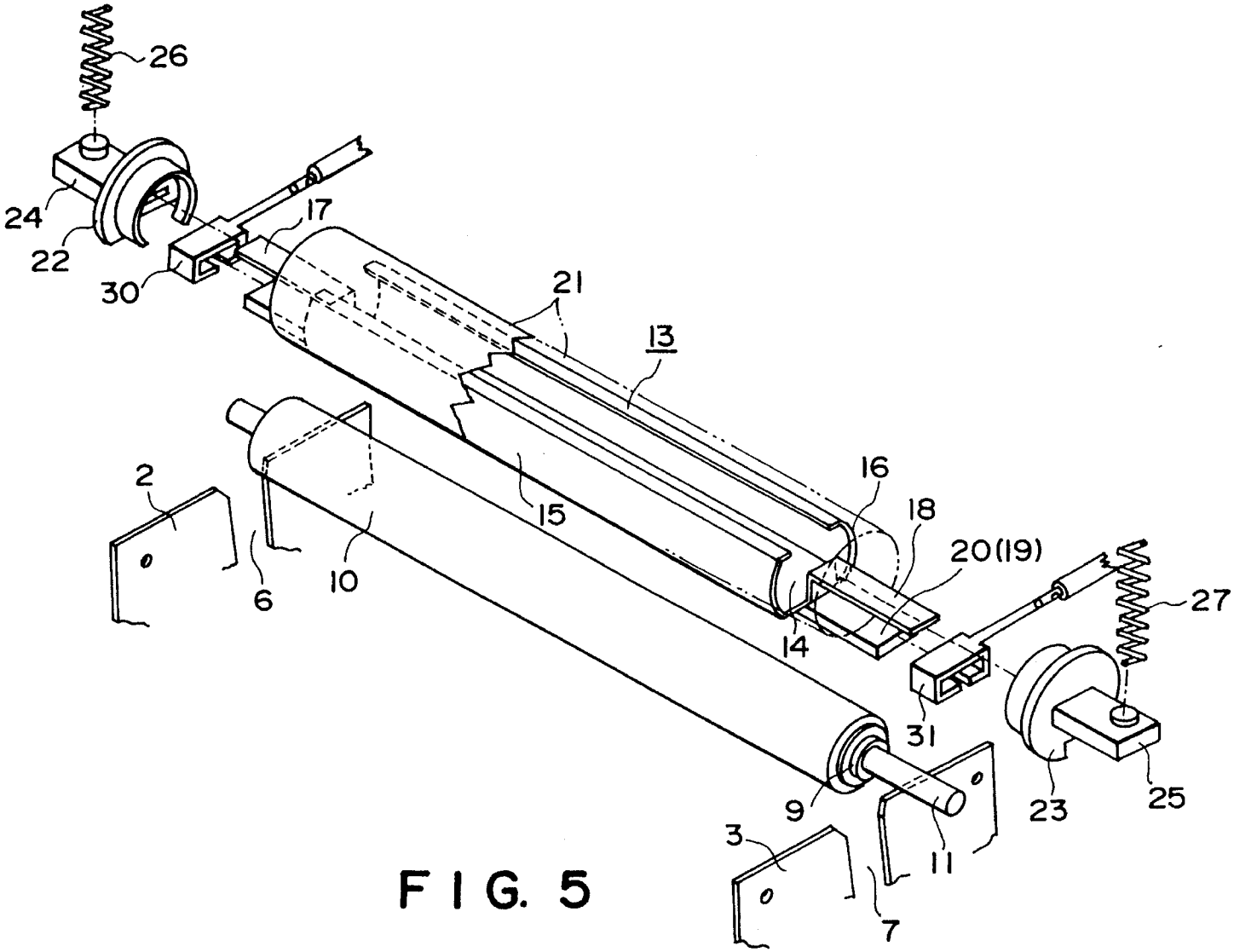
FIG. 5 is a perspective view of the major part of the image fixing apparatus.

FIG. 1 is a sectional view of a fixing device 100; FIG. 2 is a longitudinal sectional view: FIGS. 3 and 4 are a right sectional view and a left sectional view, respectively: and FIG. 5 is a perspective view of the major part. A frame 1 (bottom plate) is made of an elongated plate and has a channel-like cross section. Left and right plates 2 and 3 are integrally mounted on the frame 1 at the right and left ends. A top cover 4 is fixed to the top ends of the side plates 2 and 3 by screws 5. The top cover 4 can be removed by loosening the screws 5.

Vertically elongated slots 6 and 7 are formed in the side plates 2 and 3, respectively, at symmetrical positions. A pair of bearings 8 and 9 are fixedly mounted to the bottom of the slots 6 and 7.

A film back-up or pressing roller 10 cooperates with a heater 19, which will be described hereinafter, to form a nip with a film therebetween. The pressing roller 10 comprises a central shaft 11 and a roller portion 12 on the shaft 11 and is made of a material having a good parting property, such as silicone rubber. The left and right ends of the central shaft 11 are rotatably supported by the bearings 8 and 9. A laterally extended stay 13 is elongated and made of a plate, and functions both as an internal guide for a film 21 and as a supporting and reinforcing member for the heater 19 and a heat insulating member 20, which will be described hereinafter.

The stay 13 has a flat bottom portion 14, front and rear walls 15 and 16 extending vertically from respective longitudinal ends of the bottom portion 14 and arcing outwardly, and a pair of horizontal extensions 17 and 18 extending outwardly from left and right ends, respectively.

Figure 6:
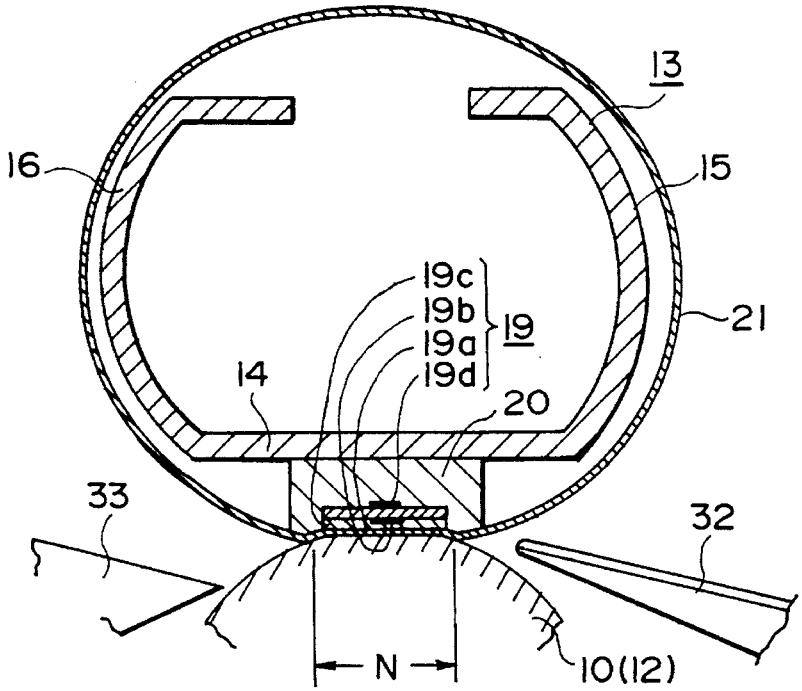
FIG. 6 is an enlarged sectional view illustrating the film when it is not driven.

As shown in FIG. 6, a low thermal capacity linear heater 19 has an elongated form, and is mounted on the elongated insulating member 20, and the insulating member 20 is integrally mounted on the bottom surface of the bottom portion 14 of the stay 13 with the linear heater 19 side facing down in parallel therewith.

A heat resistive film 21 is in the form of an endless belt, and is stretched around the stay 13 including the linear heater 19 and the insulating member 20. An internal circumferential length of the heat resistive film 21 is longer by, for example, 3 mm than the external circumferential length of the stay 13, including the linear heater 19 and the insulating member 20. Therefore, the heat resistive film 21 is loosely extended around the stay 13, including the linear heater 19 and the insulating member 20.

A pair of right and left flanges 22 and 23 function to limit the lateral ends of the heat resistive film 21, and are securedly mounted on the horizontal extensions 17 and 18 of the stay 13, after the heat resistive film 21 is mounted on the stay 13, including the linear heater 19 and the insulating member 20. As will be described hereinafter, the distance G between the internal seats 22*a* and 23*a* of the flanges 22 and 23 is slightly larger than the width C of the heat resistive film 21 (see FIG. 8).

Horizontal extensions 24 and 25 are extended outwardly from the outer surface of the flanges 22 and 23. The outward extensions 17 and 18 of the stay 13 described herein before are fitted in holes of the horizontal extensions 24 and 25 of the flanges 22 and 23, so that the left and right flanges 22 and 23 are securedly mounted.

In assembling the apparatus, when the top cover 4 is not mounted on the side plates 2 and 3, the bearings 8 and 9 mounted on the central shaft 11 of the pressing roller 10 at the longitudinal ends are inserted into the elongated slots 6 and 7 from the top until the bearings 8 and 9 are seated on the bottom of the slots 6 and 7, by which the pressing roller 10 is set between the side plates 2 and 3 (falling set).

Then, a sub-assembly constituted by the stay 13, the linear heater 19, the insulating member 20, the heat resistive film 21, and the flanges 22 and 23, is set between the side plates 2 and 3. While the heater side is facing down, the left and right extensions 24 and 25 of the flanges 22 and 23 and the extensions 17 and 18 are inserted into the slots 6 and 7 of the side plates 2 and 3, until the faced-down heater 19 is seated on the top surface of the pressing roller 10 with the heat resistive film 21 therebetween (falling set).

Coil springs 26 and 27 are positioned around projections formed on the extensions 24 and 25 of the flanges 22 and 23, respectively. The top cover 4 is set so that the extensions 28 and 29 compress the coil springs 26 and 27 between the extensions 24 and 28, and between the extensions 25 and 29. Then, the top cover 4 is secured between the left and right side plates 2 and 3 by screws.

The coil springs 26 and 27 urge the stay 13, the linear heater 19, the insulating member 20, the heat resistive film 21 and the flanges 22 and 23 downward, so that the linear heater 19 and the pressing roller 10 are pressed to each other with the heat resistive film 21 therebetween at a uniform pressure, for example, at the total pressure of 4–7 Kg.

Power supply contacts 30 and 31 are mounted on the left and right ends of the insulating member 20 penetrated outward though the respective side plates 2 and 3, and function to supply power to the linear heater 19.

A guide 32 functions to guide the material to be heated by the heater and is mounted on the front wall of the frame 1. In this embodiment, the material is a recording material or sheet P (FIG. 7) carrying a visualized or toner image Ta. The sheet p is introduced along the guide 32 into the nip N (fixing nip) between the linear heater 19 and the pressing roller 10, and more particularly, between the heat resistive film 21 and the pressing roller 10.

A separation or outlet guide 33 is mounted on the rear wall of the frame 1, and functions to guide the sheet p into a nip between a lower discharging roller 34 and a pinch roller 38 (see FIG. 1).

The left and right ends of the discharging roller 34 are rotatably supported by bearings 36 and 37 on the side plates 2 and 3. The roller 38 has a shaft 39 which is received by hook portion 40 formed by bending a part of the rear wall of the top cover 4, so that it is contacted to the top surface of the discharging roller 34 by the weight of the roller 38 and a spring 41. Thus, the 38 rotates following the roller rotation of the discharging roller 34.

A first gear G1 is fixed on the right end of the central shaft 11 extending through the right side wall 3. A third gear G3 is fixed on the right end of roller 35 extending through the right side wall 3. A second gear G2 is a relaying gear which is rotatably supported on the outer surface of the right side wall, and the second gear G2 is meshed with the first gear G1 and the third gear G3.

The first gear G1 is driven by a driving gear G0 coupled with an unshown driving source, upon which the pressing roller 10 is rotated counterclockwise in FIG. 1. Then, the rotation of the first gear G1 is transmitted through the second gear G2 to the third gear G3, so that the discharging roller 34 is rotated in the counterclockwise direction.

The description will be made as to the fixing operation of the heating apparatus according to this embodiment. As shown in FIG. 6, the heat resistive film 21 in the form of an endless belt, is tension-free except for the portion sandwiched in the nip formed between the linear heater 19 and the pressing roller 10, when the film 21 is not driven.

Figure 7:
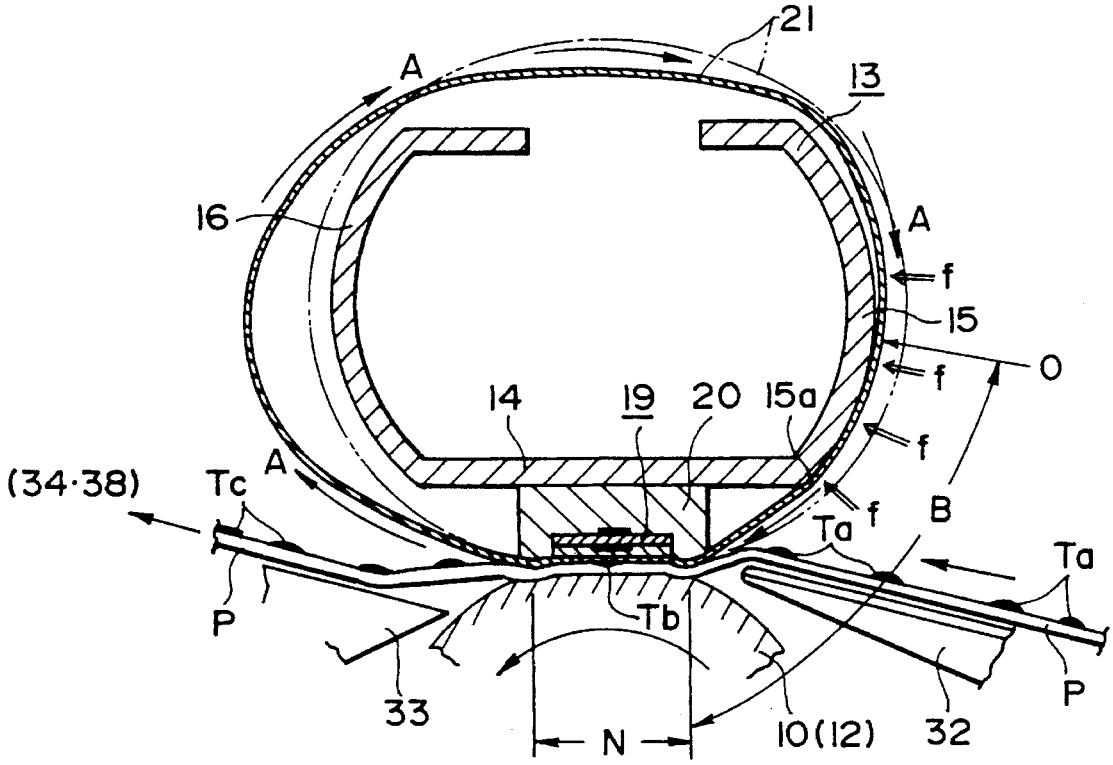
FIG. 7 is an enlarged sectional view illustrating the film when it is driven.

The driving force is transmitted from the driving source through the first gear so that the pressing roller 10 is rotated at a predetermined peripheral speed in the counterclockwise direction in FIG. 7. Then, in the nip N, the heat resistive film 21 rotates by the friction with the pressing roller 10, and the heat resistive film 21 rotates in the clockwise direction at the same peripheral speed as that of the pressing roller 10, while the inside surface of the heat resistive film 21 is in contact with the linear heater 19 surface.

In such a driving of the heat resistive film 21, pulling force f is applied to the portion of the heat resistive film 21 upstream of the nip N with respect to the rotational direction of the heat resistive film 21. Therefore, as shown in FIG. 7 by the solid lines, when the heat resistive film 21 is rotated, the inside surface of the film 21 is kept in contact with the film guiding surface upstream of the nip, and more particularly, in contact with about the bottom half of the arced front plate 15 of the stay 13 which functions as the front guide for the heat resistive film 21. As can be seen in FIG. 7, film 21 is in direct contact with front plate 15 from the point O to the trailing edge 15*a* of front plate 15 and thus such portion of front plate 15 may serve as a guiding portion. The film 21 is out of contact with front plate 15 from trailing edge 15*a* until reaching the leading edge of insulating member 20, and this portion may thus serve as a non-guiding portion.

As a result, the portion B of the heat resistive film 21 which is between the contact starting position between the front plate 15 and the heat resistive film 21 and the nip portion of the heat resistive film 21, receives the tension. Therefore, the portion B and the nip portion of the heat resistive film 21 is prevented from being creased. Particularly, since the heat resistive film 21 is stretched by the tension when it enters the nip, the crease preventing effect is significant. 15 While the film is being driven in this manner, and while the heater is supplied with the electric power, the sheet P carrying the unfixed toner image Ta is guided by the guide 32, and is introduced into the nip N between the heat resistive film 21 and the pressing roller 10 with the image carrying surface face-up. The sheet P is passed through the nip N with the heat resistive film 21 closely contacted thereto. During the passage of the sheet P, the heat is applied to the toner image Ta from the linear heater 19 in contact with the inner surface of the film, by which the toner image is fused into a softened or fused toner image therebetween.

The sheet P is separated from the heat resistive film 21 surface while the toner temperature is higher than the glass transition point, and is guided by the outlet guide 33 to the nip between the discharging roller 34 and the roller 38, and is discharged to the outside of the apparatus. By the time when the sheet P reaches the discharging roller 34, the softened or fused toner is cooled or solidified into a solidified image Tc.

As described hereinbefore, the sheet P in the nip N is always in close contact with that part of the film which is free from any crease because of the tension applied thereto, and is moved together with the film 21. Therefore, non-uniform heating, non-uniform fixing or the like can be prevented.

The heat resistive film 21 experiences the tension only at a part thereof (N,N and B) during driving or non-driving thereof. More particularly, when the heat resistive film 21 is not driven, as shown in FIG. 6, the heat resistive film 21 is tension free at almost all of the portions thereof, except for the nip portion; and when the heat resistive film 21 is driven, almost all of the portions except for portion N and portion B. In addition, the heat resistive film 21 may have a shorter circumferential length. For these reasons, the torque required for driving the film may be small, the structure of the film and the driving mechanism are simplified, and the size and the cost thereof are reduced.

Since tension is applied only in a part thereof irrespective of driving and non-driving thereof, the lateral shifting force to the heat resistive film 21, if any, in the direction, for example, of Q or R in FIG. 2, is small.

Therefore, even if the heat resistive film 21 is laterally shifted in the direction Q or R to such an extent that the left or right edge of the heat resistive film 21 abuts the inside surface of the jaw 22*a* of the left flange 22 or the right flange 23, the lateral shifting force is so small that the rigidity of the heat resistive film 21 overcomes the lateral shifting force, and therefore, the edges of the heat resistive film 21 are not yielded or damaged. The lateral shift preventing means may be simple flanges. This also contributes to the simplification of the structure of the apparatus and the reduction of the size and the cost of the apparatus.

As for an alternative for the lateral shift preventing means, the heat resistive film 21 may be provided with ribs at the lateral edges which are confined against the lateral shift.

The reduction of the lateral shifting force as described above, makes it possible to reduce the rigidity of the heat resistive film 21, so that the thickness of the film and therefore the thermal capacity of the film can be reduced to further improve the quick starting of the apparatus.

The description will be made as to the film. For the purpose of lower thermal capacity in view of the quick start of the apparatus, the total thickness of the film is not less than 100 microns, particularly, 40 microns, and not more than 20 microns. It may be a single layer or multiple layer film having good heat resistivity, parting property, mechanical strength resistivity or the like.

It may be a single layer film of a heat resistive resin such as polyimide, polyether imide (PEI), PES (polyether sulfon) PFA (tetrafluoroethylene perfluoroalkylvinyl ether copolymer resin), polyetherether ketone (PEEK), polyparabamic acid (PPA), or a multi-layer film comprising a film of 20 micron thickness and a coating layer of 10 micron thickness having good parting property at the image contacting side of the film, the coating layer being made of fluorinated resin or silicone resin such as PTFE (tetrafluoroethylene resin), PFA or FEP added with conductive material, such as carbon black, graphite, or conductive whisker.

The description will be made as to the linear heater 19 and the insulating member 20 for insulatively supporting the linear heater 19. Similar to the heater 54 shown in FIG. 13, the heater 19 comprises a heater base plate 19*a* (FIG. 6), electric heat generating element 19*b*, a surface protection layer 19*c* and a temperature sensing element 19*d*. The heater base plate 19*a* is made of a material having good heat resistivity, heat insulation, sufficiently low thermal capacity and sufficiently high heat conductivity. For example, the material may be an alumina plate having a thickness of 1 mm, width of 10 mm and length of 240 mm.

The heater 19 extends on the bottom surface of the heater base plate 19*a*, that is, the surface contacting to the heat resistive film 21, along the longitudinal center line thereof, and is provided by applying, in the form of a line or stripe of a width of approximately 1–3 mm and a thickness of approximately 10 microns, Ag/Pd (silver paradium), $Ta_2N$, $RuO_2$ or another electric resistance material by screen printing. It is then coated with a surface protection layer 19*c* of heat resistive glass having a thickness of approximately 10 microns. An example of the temperature sensing element 19*d* is a low thermal capacity temperature sensor provided by applying Pt film on the top surface of the heater base plate 19*a* (the side opposite from the heater 19*b* side) adjacent the center thereof. As an alternative, a low thermal capacity thermister is usable.

In the linear heater 19 in this embodiment, power is supplied to the linear or stripe heater 19*b* at predetermined timing intervals from an image formation signal generator so that heat is generated over the entire length of the heater.

The power source is AC 100V. The power supply is controlled by an unshown power supply control circuit in response to an output of the protection layer 19*c* by changing the phase angle of the power supply.

Upon power supply to the heater base plate 19*a*, the surface of the linear heater 19 is instantaneously heated up to a fixing temperature, for example, 140°–200° C., because the heater base plate 19*a*, the heat generating element 19*b* and the protection layer 19*c* have a small thermal capacity.

Since the thermal capacity of the heat resistive film 21 contacting to the linear heater 19 is low, the heat energy from the linear heater 19 is efficiently transmitted to the sheet P through the heat resistive film 21.

The temperature of the heat resistive film 21 is quickly heated up to a level sufficient in consideration of the fusing point of the toner or the fixable temperature for the sheet P. Therefore, a quick start of the apparatus is possible so that the necessity of a stand-by warming, which is the warming of the linear heater 19 in preparation of coming operation instructions, is eliminated. Accordingly, energy consumption can be saved, and undesirable inside temperature rise can be avoided.

The insulating member 20 is effective to thermally isolate the linear heater 19 to use the generated heat without waste. It is made of insulating and heat resistive material such as PPS (polyphenylenesulfide PAI(polyimideamide), PI(polyimide), olyetheretherketone) or liquid crystal polymer or the like.

Figure 8:
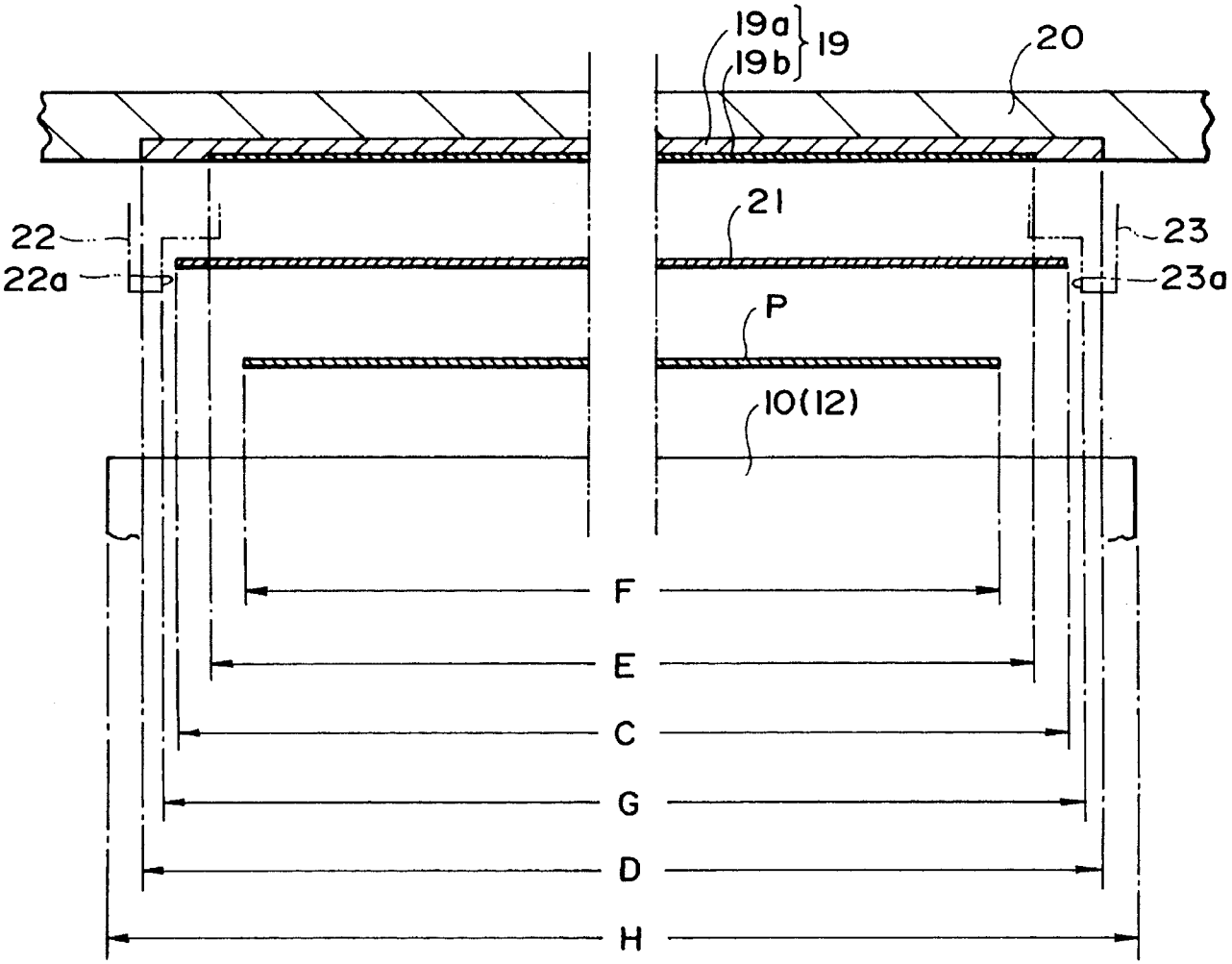
FIG. 8 illustrates dimensional relations in the direction of the width.

The description will be made as to the width C of the film and the length D of the nip. As shown in FIG. 8, it is preferable that C<D is satisfied, where C is the width of the heat resistive film 21, and D is the length of the nip N formed by the linear heater 19 and the pressing roller 10 with the film 21 therebetween.

If C≧D, the film feeding force in the area within the nip length D is significantly different from that outside the area, since in the former area, the film is driven while the inside surface thereof is in sliding contact with the linear heater 19, whereas in the latter area, the film is driven while the inside surface thereof is in sliding contact with the surface of the insulating member 20 made of a different material. The difference is so significant that the heat resistive films 21 may be creased or folded adjacent the lateral end portions.

By setting C<D, it is assured that the entire width of the inside surface of the heat resistive film 21 is in contact with the length D of the surface of the linear heater 19, while the heat resistive film 21 is driven. Therefore, the film feeding force is uniform over the entire width of the are C, whereby the trouble of the film can be avoided.

The pressing roller 10 used in this embodiment is made of material having sufficient elasticity, such as silicone rubber. This means that the surface frictional coefficient thereof changes with the temperature. Therefore, the frictional coefficient between the pressing roller 10 and the heat resistive film 21 within the length E of the heat generating element 19*a* and that between the pressing roller and the film outside the length E, are different.

In this embodiment, the dimensional relation is such that E<C<D. By doing so, the difference between the length E and the width C can be reduced, and therefore, the difference between the frictional coefficients between the pressing roller 10 and the heat resistive film 21 in the area within the length E and the outside thereof, can be reduced, so that the difference in feeding can be reduced.

Accordingly, the heat resistive film 21 can be stably fed by the pressing roller 10 without damage of the edge portions of the heat resistive film 21.

Film stopping surfaces 22*a* and 23*a* of the flanges 22 and 23 are disposed within the length of the pressing roller 10. Therefore, the edges of the heat resistive film 21 are protected even if the film is laterally shifted.

Figure 9A:
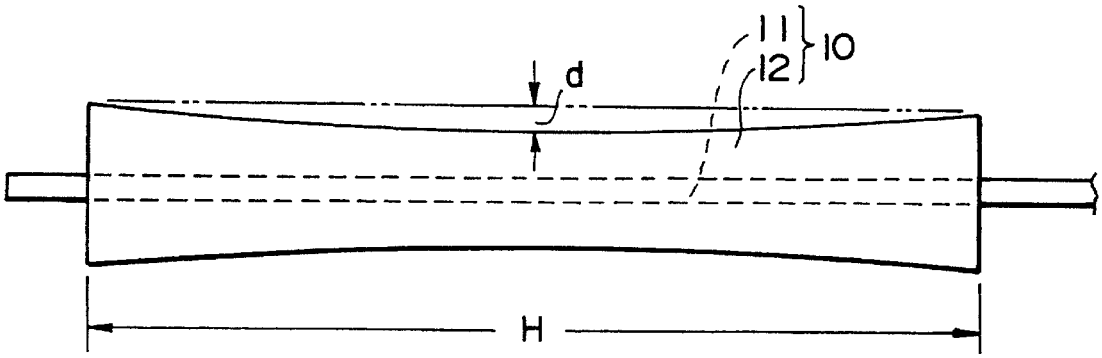
FIGS. 9A and 9B are top plan views of the pressing roller.
Figure 9B:
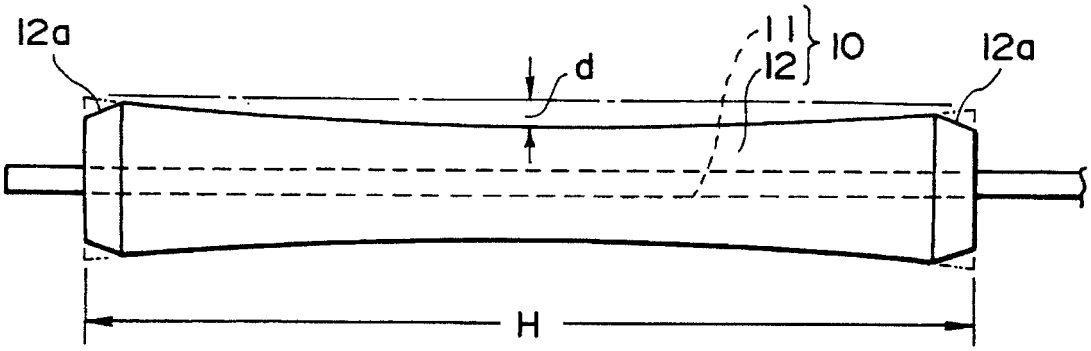

The description will be made as to the pressing roller 10. The pressing roller 10 cooperates with the linear heater 19 to form the nip N with the heat resistive film 21 therein, and functions to drive the heat resistive film 21. It is made of an elastic rubber having a good parting property, such as silicone rubber. It is not a straight roller but is reversely crowned, as shown in FIG. 9A or 9B, in which the reverse crowning is somewhat exaggerated. The longitudinal end portions may be cut out, as indicated by reference 12*a*. The degree of the reverse crowning is 100–200 microns when the effective length H of the pressing roller 10 is 230 mm, for example.

If the pressing roller 10 is a straight roller, the pressure distribution between the pressing roller 10 and the heat resistive film 21 in the nip N over the width of the film is not uniform. More particularly, the pressure is higher in the central portion than in the marginal portions, as the case may be, depending on the unavoidable manufacturing tolerances. If this occurs, the feeding force to the film is larger in the central area than in the marginal areas, and the film tends to deform toward the central portions which receive a larger feeding force. This means that the marginal portions are deformed to the central portion, with the possible result of production of a film crease and of the crease of the sheet P being introduced into the nip with such a film.

However, in the present embodiment, the pressing roller 10 is reverse crowned, and therefore, the pressure distribution is such that the pressure is higher in the marginal areas than in the central areas, so that the forces are applied to stretch the film in the laterally outward directions, and therefore, the production of a crease can be prevented in the heat resistive film 21 and the sheet P.

The pressing roller of this embodiment functions to press-contact the heat resistive film 21 to the heater 19, to drive the film at the predetermined speed, and to press-contact the sheet P to the surface of the heat resistive film 21 and drive the sheet P at the predetermined speed when the sheet P is introduced in the nip N. By doing so, the lateral shifting force is reduced, and the positional accuracy of the pressing roller 10 and the gears for driving the pressing roller 10, can be improved.

When the pressing function for urging the heat resistive film 21 or the heat resistive film 21 and the sheet P, and the moving function for moving the heat resistive film 21, are performed by a pressing rotatable member (the necessary pressure is provided by pressing the rotatable member), and a film driving rotatable member, respectively, then the lateral edges of the heat resistive film 21 are liable to be creased or folded, if the alignment between the linear heater 19 and the film driving mechanism, are disturbed. When a pressing member functioning also as the film driving member is urged by springs or the like to urge the pressing members to the linear heater 19, the position of the rotatable member or the gears for driving the rotatable member is not easily determined.

In this embodiment, the pressure required for fixing is applied to the linear heater 19; the pressing roller 10 functions to urge the sheet P to the heat resistive film 21: and the pressing roller 10 also functions to drive the heat resistive film 21 and the sheet P. Therefore, the advantageous effects described herein-before; and can be provided. In addition, the structure of the apparatus can be simplified, and a low cost reliable apparatus can be provided.

Figure 10:
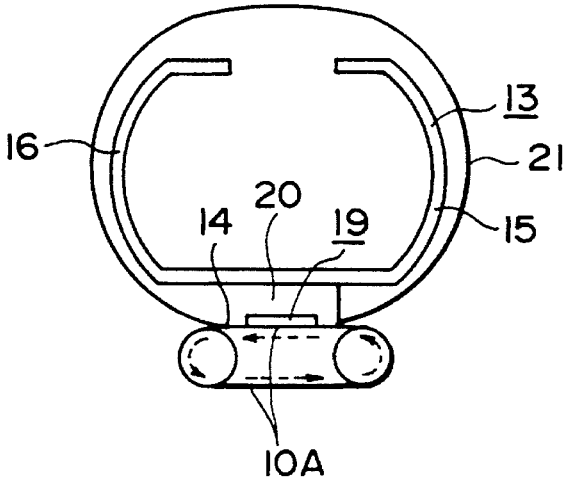
FIG. 10 is a sectional view of the image fixing apparatus according to a second embodiment of the present invention.

The pressing roller 10 may be in the form of an endless belt 10A, as shown in FIG. 10.

Figure 13:
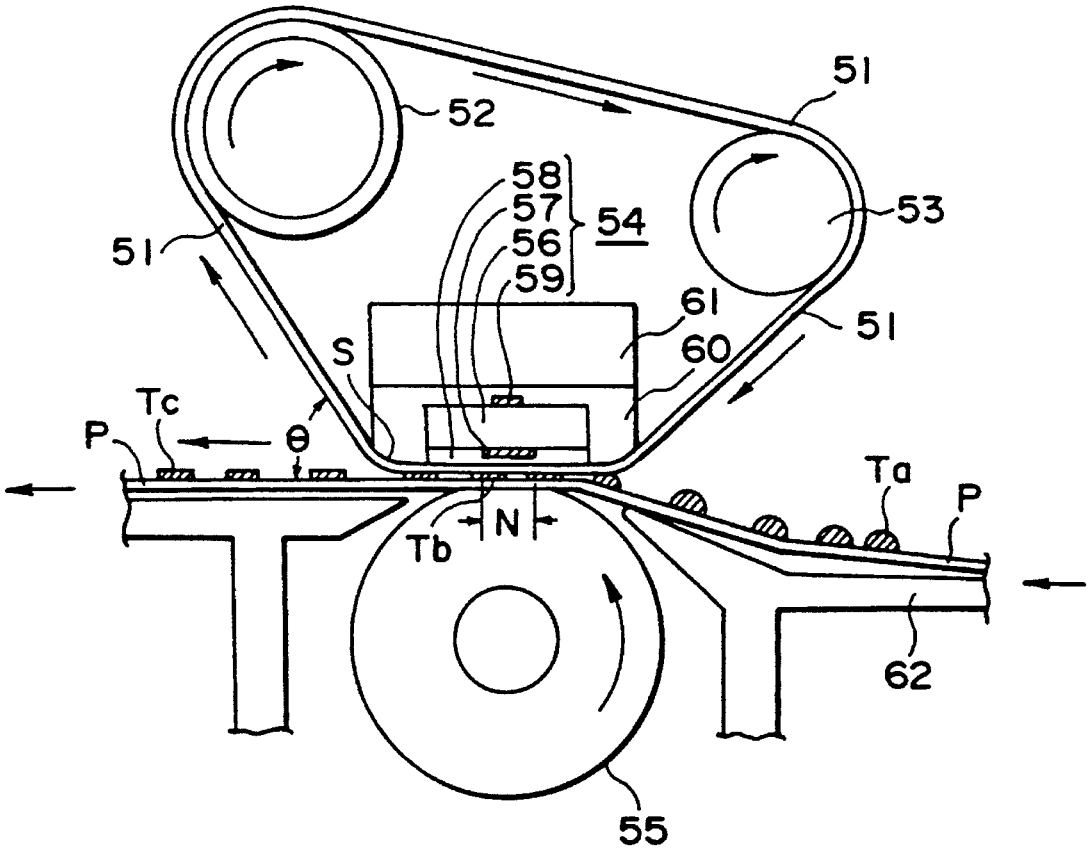
FIG. 13 PRIOR ART
FIG. 13 is a sectional view of an example of a heating apparatus.

The structure wherein the rotatable member 10 or 10A has the functions of urging the heat resistive film 21 to the linear heater 19 and to drive the heat resistive film 21 is usable with the tension free type apparatus as in this embodiment (at least a part of the heat resistive film 21 is tension free irrespective of whether the heat resistive film 21 is driven or not), and usable with the film tension type (as shown in FIG. 13, the circumferentially long film is always tensioned). In addition, it is usable with various types of lateral shift preventing means such as a sensor-solenoid type, rib-stopper type or end limiting type (one side or two sides). The same advantageous effects can be provided, but the present invention is most suitable to the tension free type apparatus.

The description will be made as to the sheet discharging speed. The sheet conveying speed V10 by the pressing roller 10 in the nip N (the peripheral speed of the pressing roller 10), the sheet discharging speed V34 of the discharging roller 34 (the peripheral speed of the discharging roller 34) preferably satisfy V10>V34. The difference therebetween is several percent, 1–3%, for example.

If the maximum dimension F (FIG. 8) usable with the apparatus is such that F<C, where C is the width of the film 21, that portion of the sheet P bridging between the nip N and the discharging roller 34 which is in the nip N is stretched by the discharging roller 34, if V10≦V34.

The heat resistive film 21 coated with a good parting property material such as PTFE is moved at the same speed as the pressing roller 10. On the other hand, the sheet P receives the pulling force in addition to the driving force by the discharging roller 34, and therefore, it is driven at a speed higher than the peripheral speed of the pressing roller 10. That is, the sheet P slips relative to the heat resistive film 21 in the nip N. This may disturb the unfixed toner image Ta (FIG. 7) or the soft or fused toner image therebetween in the nip N.

By satisfying V10>V34 described above, the sheet P is not pulled by the discharging roller 34 and receives only the feeding force by the pressing roller 10. Therefore, disturbance to the image due to slippage between the sheet P and the heat resistive film 21 can be avoided.

The discharging roller 34 is disposed in the fixing device 100 side, but the fixing device 100 may be in the main apparatus using the fixing device.

The description will be made as to the interval between the film lateral edge limiting flanges. The distance G between the inside surfaces of the jaws 22*a* and 23*a* of the flanges 22 and 23 when, for example, the distance C is 230 mm, preferably is larger by 1–3 mm.

The heat resistive film 21 is expanded by the heat from the linear heater 19 in the nip N, at a temperature, for example, of 200° C. Therefore, if the width C of the heat resistive film 21 and the flange interval G are equal to each other (C=G), and the heat resistive film 21 is limited by the flanges 22 in the normal temperature, then the width C becomes larger than the flange interval G, with operation of the apparatus. Since the heat resistive film 21 is thin, for example, 50 microns, if the heat resistive film 21 width C becomes larger than the flange interval G, the edge pressure of the heat resistive film 21 becomes so large that the edge or edge are folded or yielded. In addition, the friction between the edge of the heat resistive film 21 and the flanges 22 is also increased, and the heat resistive film 21 feeding is influenced.

By setting the dimensions so as to satisfy C<G, even if the heat resistive film 21 is expanded by heat, simultaneous contact of the lateral ends of the heat resistive film 21 can be avoided with the surfaces 22*a* and 23*a*.

Thus, even if the heat resistive film 21 is expanded, the pressure between the heat resistive film 21 and the flanges 22 does not increase. So, the edge damage of the heat resistive film 21 can be avoided, and the driving force required for the film feeding can be avoided.

The description will be made as to the relations among friction coefficients. The friction coefficients are defined, as follows:

μ1: friction coefficient between the outer peripheral of the heat resistive film 21 and the surface of the pressing roller 10:

μ2: friction coefficient between the internal surface of the heat resistive film 21 and the surface of the linear heater 19:

μ3: friction coefficient between the surface of the linear heater 19 and the surface of the linear heater 19:

μ4: friction coefficient between the surface of the sheet P and the outer surface of the heat resistive film 21:

μ5: friction coefficient between the surface of the recording material P and the surface of the pressing roller 10:

L1: the maximum length of the sheets usable with the apparatus:

L2: length, measured along the sheet feeding passage, of the passage from an image transfer station to the fixing nip N, when the image forming apparatus has a transfer station.

The frictional coefficient satisfies μ1>μ2. Preferably, the friction coefficient (static) μ1 is not less than 1, and most preferably, is not more than 10; and the friction coefficient (static) $\mu 2$ is not more than 0.2.

In this type of fixing apparatus, usually, $\mu 4<\mu 5$, and in a usual image forming apparatus, L1>L2.

If $\mu 1 \leqq \mu 2$, the slip occurs between the heat resistive film 21 and the sheet P in the cross-sectional direction of the fixing apparatus (the heat resistive film 21 speed is lower than the pressing roller 10 peripheral speed). Then, the toner image is disturbed.

If the sheet P and the heat resistive film 21 integrally slips relative to the heat resistive film 21 (the speed of the heat resistive film 21 and the sheet P is lower than the speed of the roller 10) the toner image will be disturbed when the image is transferred onto the sheet P in the transfer station.

By setting $\mu 1>\mu 2$, slip between the pressing roller 10 and the heat resistive film 21 can be avoided. In addition, $\mu 1>\mu 3$ is preferably satisfied, under the condition that C<H and C<H are satisfied, where C is the width of the heat resistive film 21, H is the length of the rotatable roller 10, and D is the length of the linear heater 19.

If this is not satisfied, the heat resistive film 21 and the pressing roller 10 slip, with the result that the heat resistive film 21 slips relative to the sheet P, and therefore, the toner image on the sheet P is disturbed.

By satisfying $\mu 1>\mu 3$, the slip can be prevented in the width direction, particularly outside the sheet P between the pressing roller 10 and the heat resistive film 21.

As described hereinbefore, by satisfying $\mu 1>\mu 2$ and $\mu 1>\mu 3$, it is assured that the speeds of the heat resistive film 21 and the sheet P are the same as the speed of the pressing roller 10, so that the disturbance of the toner image in the fixing and transfer operations can be avoided. By satisfying both simultaneously, the speeds of the heat resistive film 21, the pressing roller 10 and the sheet P are at all times the same. Particularly in the image transfer type apparatus, the image fixing operation is stabilized.

Figure 11:
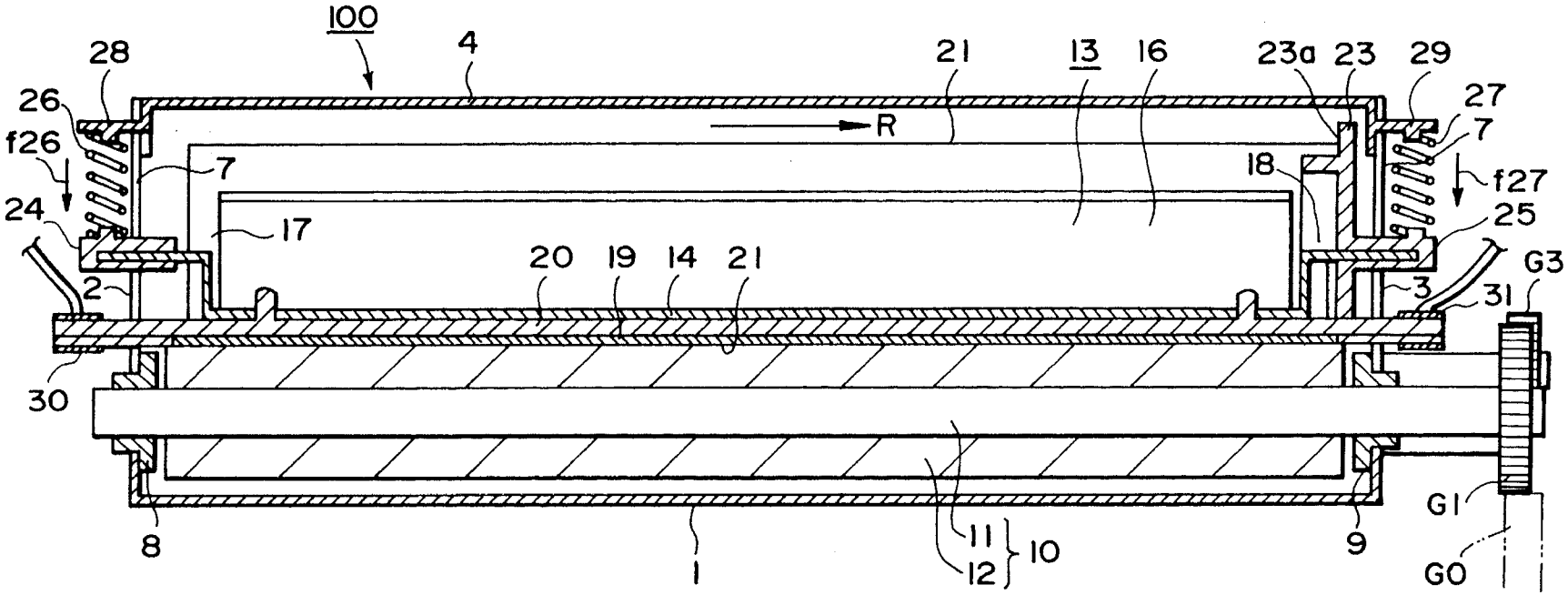
FIG. 11 is a sectional view of the image fixing apparatus according to a third embodiment of the present invention.

Referring to FIG. 11, an additional embodiment will be described. In this embodiment, a pressure f27 by the driving side spring 27 (right side) is made lower than the pressure f26 by the driven side spring 26 (left side) (f27<f26). By doing so, whenever the heat resistive film 21 is driven, the heat resistive film 21 is urged toward the right R along the length of the stay 13. Only the R side lateral edge of the heat resistive film 21 is limited by a flange 27, by which the lateral shift of the heat resistive film 21 can be stably controlled. According to this embodiment, the lateral shift limiting means may be the single flange 23, and therefore, the structure of the apparatus is simplified, and the size and the cost of the apparatus can be reduced.

Figure 12:
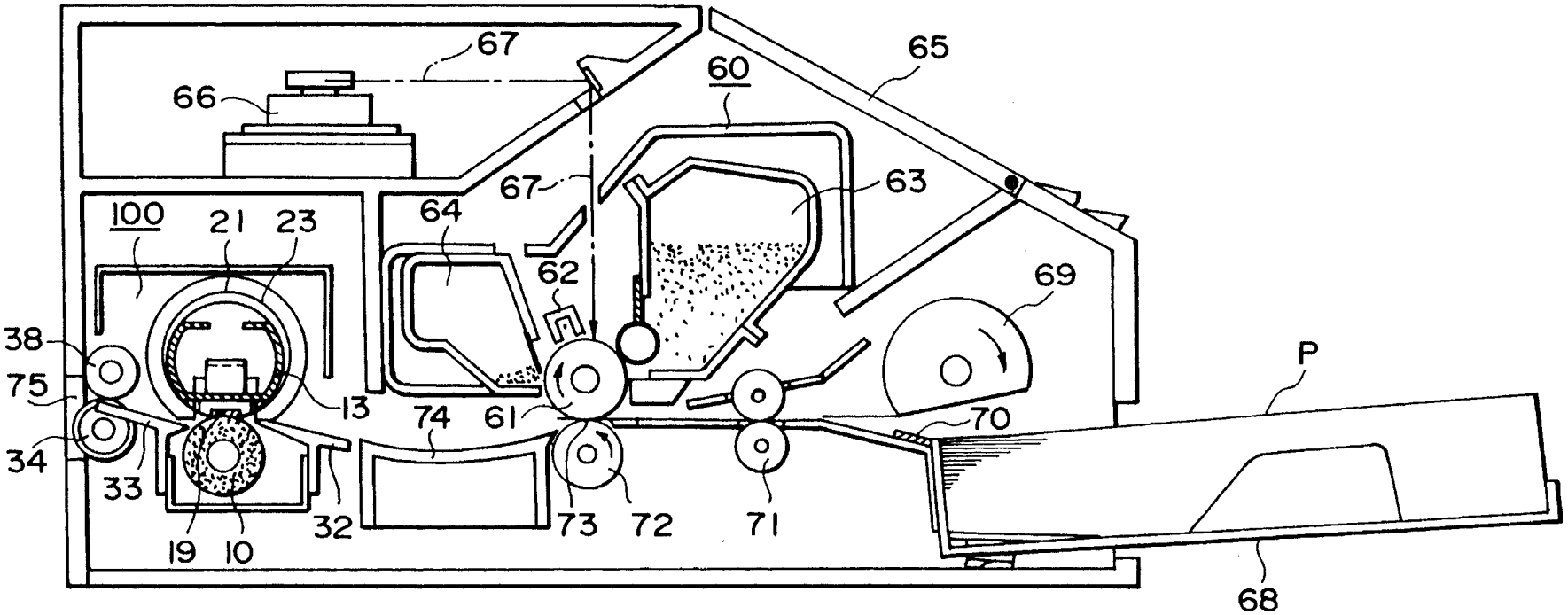
FIG. 12 is a sectional view of an image forming apparatus using the image fixing apparatus according to an embodiment of the present invention.

As for the means for urging the heat resistive film 21 in one direction in operation, the pressures by the springs 26 and 27 are made different. Alternatively, the configurations of the linear heater 19 or the pressing roller 10 are made different at the driving side than at the driven side to control the film feeding force so as to shift the heat resistive film 21 in one direction. The lateral shifting tendency in this embodiment is lower than that in the previous embodiment, and therefore, the lateral shift limiting means may be preferably provided at both sides. Referring to FIG. 12, description will be made as to the image forming apparatus using the image heating apparatus as an image fixing means. The image forming apparatus shown is a laser beam printer, which comprises a process cartridge 60 containing an electrophotographic photosensitive member in the form of a rotatable drum 61, a charger 62, a developing device and a cleaning device (four process means). The process cartridge is detachably mountable when the apparatus is opened at the portion 65.

In operation, the drum 61 rotates in the direction of the arrow (clockwise direction) upon generation of image formation start signal. The surface of the drum 61 is uniformly charged by the charger 62 to a predetermined potential of a predetermined polarity, and is then exposed to a scanning laser beam 67 which is produced from a laser scanner 66 and modulated in accordance with the image information to be recorded (time series digital pixel signals), so that an electrostatic latent image is formed on the drum 61 in accordance with the desired image information. The latent image is developed into a toner image.

On the other hand, a shed P is fed out of a sheet cassette 68 by cooperation of a sheet pick-up roller 69 and a separation pad 70, one by one, and is fed, in timed relation with the toner image on the drum 61 by a pair of registration rollers 71, to an image transfer station 73 having an image transfer roller 72 press-contacted to the drum 61 to form an image transfer nip, where the image is transferred from the drum 61 onto the sheet P.

The sheet P now having the transferred image, is separated from the drum 61, and is supplied into the fixing device 100, where the toner image is fixed by heat. The sheet P is finally discharged through an outlet 75 as a print.

The surface of the drum 61 from which the image has been transferred at the transfer station 73, is cleaned by the cleaning means 64, so that contaminants such as the residual toner are removed. Then, the drum 61 is prepared for the next image forming operation. The heating apparatus of the present invention is usable not only as image fixing means but also as image improving means by increasing the glossiness of the image surface.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater;

an endless film movable in contact with said heater;

a back-up member cooperative to form a nip with said heater with said film therebetween, wherein said nip is effective to feed a recording material carrying an image and to heat the image by heat from said heater through said film; and a guiding member for guiding said film, said film being loosely extended around said guiding member, and said guiding member having a guiding portion at a position upstream of said heater with respect to a movement direction of said film, wherein said film is tensioned at the guiding portion and the nip as said film is being driven, and wherein said guiding member has a non-film-guiding portion, which does not guide said film, provided between said guiding portion and aid nip.

2. An apparatus according to claim 1, wherein when said film is not driven, said film is tension-free except for where it is in the nip.

3. An apparatus according to claim 1, wherein the recording material contacts said film between said guiding portion and said nip.

4. An apparatus according to claim 1, wherein said film is of heat resistive resin material.

5. An apparatus according to claim 1, wherein said guiding member has an arcuated guiding portion.

6. An apparatus according to claim 1, wherein said film is driven at its portions subjected to the tension.

7. An apparatus according to claim 6, wherein said back-up member is in the form of a rotatable member driven by a driving source and drives said film.

8. An apparatus according to claim 1, further comprising a limiting member for limiting a lateral edge of said film.

9. An apparatus according to claim 8, wherein the limiting member limits a portion of said film which is subjected to tension at least when said film is driven.

10. An apparatus according to claim 9, wherein said limiting member is provided for substantially the entire circumference of said film except for the portion of the film passing through the nip.

11. An apparatus according to claim 8, wherein the limiting member is provided for limiting each of the lateral edges of said film.

12. An apparatus according to claim 8, wherein said film is provided with a tendency of shifting in a lateral direction, and said limiting member is at one side to which said film tends to shift.

13. An apparatus according to claim 1, wherein said heater is stationary in use, and said film slides on said heater.

14. An apparatus according to claim 1, wherein said apparatus heat-fixes the image on the recording material.

* * * * *

UNITED STATES PATENT AND TRADEMARK OFFICE

CERTIFICATE OF CORRECTION

PATENT NO. : 5,525,775

DATED : June 11, 1996

INVENTOR(S) : TAKESHI SETORIYAMA, ET AL.

It is certified that error appears in the above-indentified patent and that said Letters Patent is hereby corrected as shown below:

Column 1,
line 23, "the" (first occurrence) should be deleted; and
line 37, "of" should read --of a--.

Column 4,
line 57, "sheet p" should read --sheet P--; and
line 63, "sheet p" should read --sheet P--.

Column 5,
line 5, "the 38" should read --the roller 38--, and "roller" should be deleted.

Column 6,
line 9, "when" should be deleted;
line 18, "the" should be deleted; and
line 19, "(N,N" should read --(N or N--.

Column 7,
line 16, "to" should be deleted;
line 45, "to" should be deleted;
line 61, "(polyphenylenesulfide" should read --(polyphenylenesulfide),--; and
line 62, "olyetheretherketone)" should read --olyetheretherketone--.

Column 8,
line 15, "are" should read --area--.

Column 9,
line 34, "herein-before; and" should read --hereinbefore--.

UNITED STATES PATENT AND TRADEMARK OFFICE

CERTIFICATE OF CORRECTION

PATENT NO. : 5,525,775

DATED : June 11, 1996

INVENTOR(S) : TAKESHI SETORIYAMA, ET AL.

It is certified that error appears in the above-indentified patent and that said Letters Patent is hereby corrected as shown below:

Column 10,
line 1, "the" (first occurrence) should read --a--;
and
line 8, "V10>V34" should read --V10>V34, as--.
Column 11,
line 5, "the" (first occurrence) should be deleted;
and
line 25, "the" (first occurrence) should be deleted.
Column 12,
line 4, "of" should read --of the--;
line 14, "shed" should read --sheet--; and
line 59, "aid" should read --said--.

Signed and Sealed this

Nineteenth Day of November, 1996

*Attest:*

Bruce Lehman

BRUCE LEHMAN

*Attesting Officer*

*Commissioner of Patents and Trademarks*